US007583926B2

(12) United States Patent
Tamehira et al.

(10) Patent No.: US 7,583,926 B2
(45) Date of Patent: Sep. 1, 2009

(54) IMAGE RECORDING APPARATUS

(75) Inventors: Masato Tamehira, Nara (JP); Junya Masuda, Ikoma (JP); Yoshinori Shiraishi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 341 days.

(21) Appl. No.: 11/465,833

(22) Filed: Aug. 21, 2006

(65) Prior Publication Data

US 2007/0048052 A1 Mar. 1, 2007

(30) Foreign Application Priority Data

Aug. 25, 2005 (JP) ..... 2005-244156

(51) Int. Cl.
*G03G 15/00* (2006.01)

(52) U.S. Cl. ..... 399/388; 399/364; 399/397; 399/401; 399/405; 271/65; 271/225

(58) Field of Classification Search ..... 399/364, 399/388, 397, 401, 405; 271/65, 225
See application file for complete search history.

(56) References Cited

U.S. PATENT DOCUMENTS

2003/0063936 A1 * 4/2003 Sasaki et al. ..... 399/401

FOREIGN PATENT DOCUMENTS

| | | |
|---|---|---|
| JP | 01-308354 | 12/1989 |
| JP | 06-180519 A | 6/1994 |
| JP | 2003-104613 A | 4/2003 |

* cited by examiner

*Primary Examiner*—Judy Nguyen
*Assistant Examiner*—Andy L Pham
(74) *Attorney, Agent, or Firm*—Renner, Otto, Boisselle & Sklar, LLP

(57) ABSTRACT

An image recording apparatus includes first to fifth transport paths. The first path transports a sheet from a sheet feeding section to a sheet output section through a first confluence, an image recording section, a first bifurcation, and a second confluence in that order. The second path transports a sheet from the first bifurcation down to a switchback section through a second bifurcation and a third bifurcation in that order. The third path transports a sheet from the third bifurcation to the first confluence through a third confluence, and vice versa. The third path is positioned between the switchback section and a portion of the first transport path located in the image recording section. The fourth path transports a sheet from the second bifurcation to the third confluence, and vice versa. The fifth path transports a sheet from the second bifurcation to the second confluence.

4 Claims, 7 Drawing Sheets

IMAGE RECORDING APPARATUS

CROSS REFERENCE

This Nonprovisional application claims priority under 35 U.S.C. § 119(a) on Patent Application No. 2005-244156 filed in Japan on Aug. 25, 2005, the entire contents of which are hereby incorporated by reference.

BACKGROUND OF THE INVENTION

The invention relates to an image recording apparatus for recording an image on a sheet while transporting the sheet from a sheet feeding section to a sheet output section.

A duplex image recording apparatus is a type of image recording apparatus, which is used for recoding an image on both sides of a sheet.

JP 2003-104613A discloses a duplex image recording apparatus provided with a re-transport path and a reversing transport path. The re-transport path connects a first portion of a main transport path (which leads from a sheet feeding section to a sheet output section through an image recording section) positioned between the image recording section and the sheet output section, to a second portion of the main transport path positioned between the sheet feeding section and the image recording section. The reversing transport path, which branches out from a portion of the re-transport path, is used for transporting a sheet in forward and backward directions therein.

After a sheet has an image recorded on a first side, a leading end and a tail end of the sheet are reversed in the reversing transport path. Thus, the sheet is transported to the image recording section, with a second side facing the image recording section.

There is another type of image recording apparatus having the functions of performing face-up output process and face-down output process. In the face-up output process, a sheet is output to a sheet output section with an image-recorded side facing upward, and in the face-down output process, a sheet is output with an image-recorded side facing downward.

In a copying operation where an image of original document is to be copied on a sheet of paper, an operator is around the apparatus and, thus, can check the copied sheet if the sheet is output face-up to the sheet output section. When an image is to be recorded on a sheet according to image data received through a network from a terminal device, an operator is not around the apparatus. Thus, a sheet can be output face-down so that an image recorded thereon may not be readily seen by others. In this type of image recording apparatus, a sheet is turned upside down by reversing a leading end and a tail end of a sheet in a portion of a main transport path positioned between an image recording section and the sheet output section. A sheet is selectively reversed upside down after passing through the image recording section, so that the sheet is selectively output to the sheet output section with an image-recorded side facing upward or downward.

In order to incorporate the function of reversing a sheet into duplex image recording apparatus, an additional sheet transport path is required that leads from a reversing transport path to a sheet output section. Also, a plurality of bifurcations are required to be provided in the main transport path, the re-transport path, and the reversing transport path. However, the additional transport path may cause the apparatus to be upsized and therefore to take a longer time to transport a sheet therein. Also, a sheet jam is more likely to occur in the bifurcations. Furthermore, random arrangements of the bifurcations complicate a process of removing a jammed sheet.

A feature of the invention is to provide an image recording apparatus with the functions of duplex image recording and reverse sheet output, that includes a main transport path, a re-transport path, a reversing transport path, and a plurality of bifurcations, positioned in optimum arrangements that prevent the apparatus from being upsized, a sheet transport time from taking long, and a process of removing a jammed sheet from being complicated.

SUMMARY OF THE INVENTION

An image recording apparatus includes first to fifth transport paths. The first transport path transports a sheet from a sheet feeding section to a sheet output section through a first confluence, an image recording section, a first bifurcation, and a second confluence in that order. The second transport path transports a sheet from the first bifurcation down to a switchback section through a second bifurcation and a third bifurcation in that order. The third transport path transports a sheet from the third bifurcation to the first confluence through a third confluence, and vice versa. The third transport path is positioned between the switchback section and a portion of the first transport path located in the image recording section. The fourth transport path transports a sheet from the second bifurcation to the third confluence, and vice versa. The fifth transport path transports a sheet from the second bifurcation to the second confluence.

DETAILED DESCRIPTION OF THE INVENTION

Image recording apparatus according to preferred embodiments of the invention will be described below with reference to the accompanying drawings.

Figure 1:
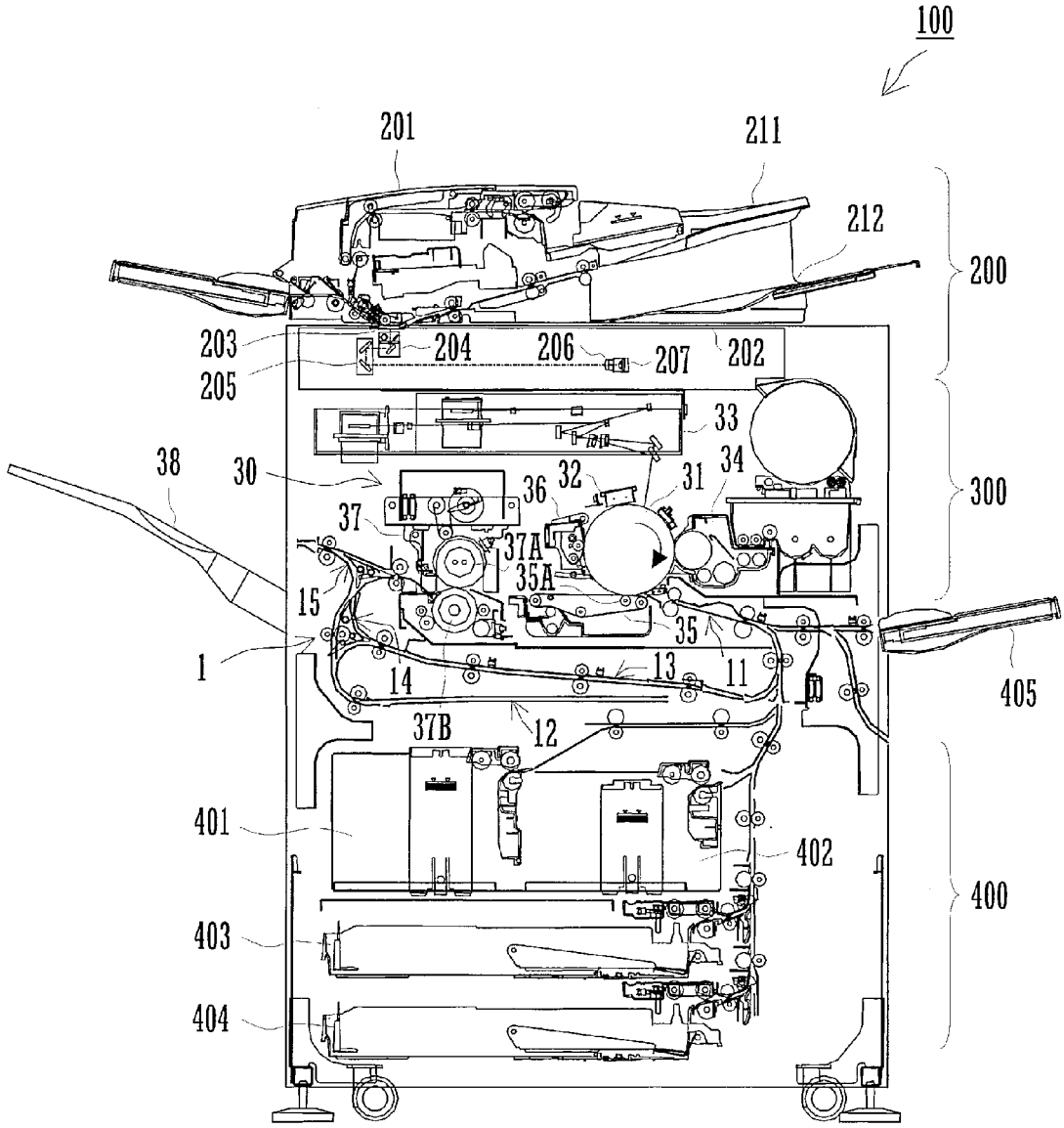
FIG. 1 is a schematic front cross-sectional view illustrating a configuration of an image recording apparatus according to an embodiment of the invention.

FIG. 1 is a schematic front cross-sectional view illustrating a configuration of an image recording apparatus according to an embodiment of the invention, such as an apparatus 100. The apparatus 100 includes an image reading unit 200, an image forming unit 300, and a sheet feeding unit 400.

The unit 200 has an automatic document feeder (ADF) 201, a first document platen 202, a second document platen 203, a first mirror base 204, a second mirror base 205, a lens 206, and a charge coupled device (CCD) 207.

The ADF 201 feeds an original document, sheet by sheet, from a document tray 211 through the second document platen 203 to a first output tray 212. The ADF 201 is mounted so as to be pivotable about a rear-end pivot between an open position and a closed position. In the closed position, the ADF 201 covers the platen 202. The ADF 201 is pivoted upward to the open position to expose the platen 202, so that a user can place an original document manually on the platen 202. Each of the platens 202 and 203 includes a hard glass plate.

The bases 204 and 205 are provided below the platens 202 and 203 so as to be movable horizontally. The base 205 moves half as fast as the base 204. On the base 204, a light source and a first mirror are mounted. On the base 205, a second mirror and a third mirror are mounted.

In reading an image of original document that is being transported by the ADF 201, the base 204 is held still below the platen 203. While passing on the platen 203, an original document is irradiated with light from the light source. The reflected light is in turn reflected from the first mirror to the base 205.

In reading an image of original document placed on the platen 202, the bases 204 and 205 are moved horizontally below the platen 202. An original document placed on the platen 202 is irradiated with light from the light source. The reflected light is in turn reflected from the first mirror to the base 205.

Regardless of whether an original document is fed by the ADF 201 or placed on the platen 202, thus, the reflected light from the original document is in turn reflected from the second and third mirrors, and then strikes the CCD 207 through the lens 206.

The CCD 207 outputs electric signals according to an amount of the reflected light from the original document. The electric signals are input to the image forming unit 300 as image data.

The unit 300 is provided with an image recording section 30. The section 30 includes a photoreceptor drum 31, a charging device 32, an exposure device 33, a developing device 34, a transfer belt 35, a cleaner 36, and a fusing device 37.

The drum 31, which has an outer photoreceptive surface, is rotatable in a direction indicated by an arrow. The charging device 32 applies, to the surface of the drum 31, such a voltage as to allow the surface to have a uniform electric potential. The device 32 may be either a noncontact charger, or a contact charger of roller or brush type.

The exposure device 33 irradiates the surface of the drum 31 with light modulated according to image data, so that an electrostatic latent image is formed on the surface. The device 33 has a polygon mirror through which to scan the drum 31 axially with a laser light modulated according to image data. Alternatively, an exposure device provided with an array of light emitting elements such as ELs or LEDs may be used as the device 33.

The developing device 34 supplies toner to the surface of the drum 31 and develops the electrostatic latent image into a toner image.

Under the drum 31, the transfer belt 35 is looped over a plurality of rollers. The belt 35 has a resistance of $1\times10^{9}$ Ω·cm to $1\times10^{13}$ Ω·cm. Inside the loop of the belt 35, a transfer roller 35A is provided so as to be pressed against the drum 31 through the belt 35. A predetermined amount of transfer voltage is applied to the roller 35A, so that a toner image is transferred from the drum 31 to a sheet that passes between the belt 35 and the drum 31.

The cleaner 36 removes residual toner that remains on the drum 31 after a toner image is transferred from the drum 31 to a sheet.

The fusing device 37 has a heat roller 37A and a pressure roller 37B. The roller 37A is heated, by an internal heater, to a sufficient temperature to melt toner. The roller 37B is pressed against the roller 37A at a predetermined pressure. The device 37 heats and pressurizes a sheet passing between the rollers 37A and 37B, thereby firmly fixing a toner image to the sheet. After passing through the device 37, a sheet is output to a second output tray 38 mounted on a side surface of the apparatus 100. The tray 38 corresponds to the sheet output section of the invention.

The sheet feeding unit 400 corresponds to the sheet feeding section of the invention. The unit 400 has sheet cassettes 401, 402, 403, and 404, and a manual sheet feeding tray 405. Each of the cassettes 401 to 404 holds a plurality of sheets of the same size. The tray 405 is provided for holding sheets of sizes and types that are used infrequently.

The unit 400 feeds sheets, one by one, from any one of the cassettes 401 to 404 and the tray 405. A sheet fed by the unit 400 is transported to the image recording section 30 along a sheet transport path 1 to be described below.

Figure 2:
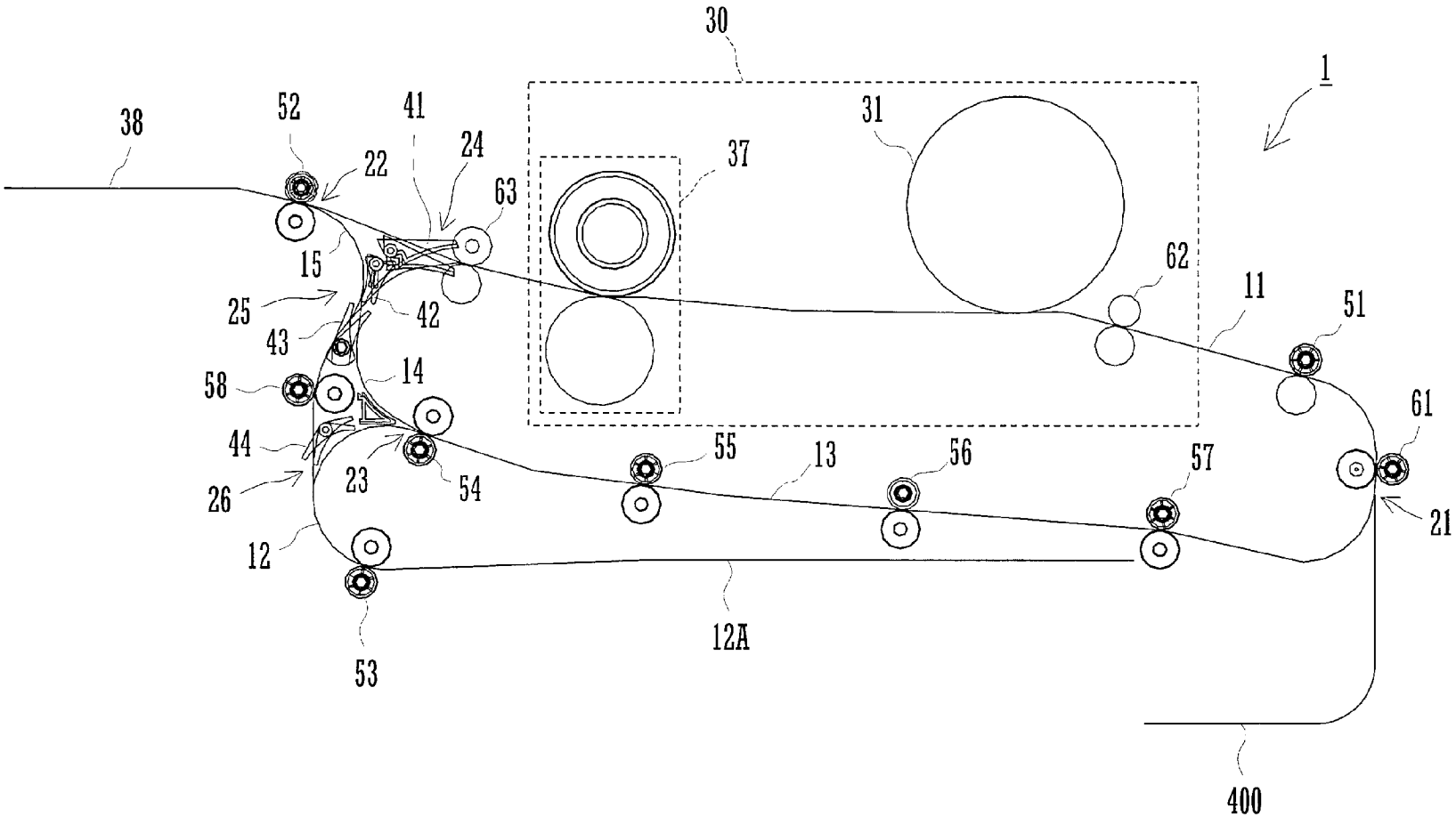
FIG. 2 is a diagram illustrating a configuration of a sheet transport path provided in the apparatus.

FIG. 2 is a diagram illustrating a configuration of the sheet transport path 1. The path 1 is provided inside the image forming unit 300. The path 1 includes a first path 11, a second path 12, a third path 13, a fourth path 14, and a fifth path 15.

The first path 11 leads from the unit 400 to the tray 38, through a first confluence 21, the section 30, a first bifurcation 24, and a second confluence 22 in that order. Arranged along the path 11 are transport rollers 61, 62, and 63, a registration roller 51, and an output roller 52. The transport rollers 61 to 63, the registration roller 51, and the output roller 52 are driven by a first motor (not shown).

A portion of the path 11 located in the section 30 is in an approximately horizontal position. In the first portion, the belt 35 is arranged for stable transfer of toner image from the drum 31 to a sheet and for stable transport of a sheet with an pre-fusion toner image electrostatically attracted thereto.

The first bifurcation 24 is located between the section 30 and the tray 38. The second path 12 leads from the bifurcation 24 to a switchback section 12A, through a second bifurcation 25 and a third bifurcation 26 in that order. The section 12A is located below and parallel to the portion of the path 11 located in the section 30. The section 12A transports a sheet in forward and backward directions therein. Along the path 12, there are provided a reversing roller 53 and a transport roller 58. The roller 53 is selectively driven in a frontward direction or a backward direction through a first clutch (not shown) by a second motor (also not shown). The roller 58 is driven by the first motor (not shown).

The third path 13 leads from the third bifurcation 26 to the first confluence 21 through a third confluence 23. The path 13 is located between the section 12A and the portion of the path 11 located in the section 30. Along the path 13, transport rollers 54, 55, 56, and 57 are arranged. The rollers 54 to 57 are selectively driven in a frontward direction or a backward direction through a second clutch (not shown) by a third motor (also not shown).

The fourth path 14 leads from the bifurcation 25 to the confluence 23. The fifth path 15 leads from the bifurcation 25 to the confluence 22.

The reversing rollers 54, 55, 56, and 57 are approximately evenly spaced along the path 13. Thus, the path 13 needs a relatively large space thereabove and thereunder. In contrast, the single reversing roller 53 is provided around a mouth of the switchback section 12A. Thus, the section 12A does not need a large space thereabove and thereunder.

Accordingly, the sheet transport path 1 can be rendered compact by arranging the portion of the path 11 located in the section 30, the section 12A, and the path 13 in three layers, in that order from top to bottom.

Also, the bifurcations 24, 25, and 26, where a sheet jam is relatively more likely to occur, are arranged along a portion of the path 12, in that order from top to bottom. Thus, the bifurcations 24 to 26 are exposed to the outside by opening a side surface of the apparatus 100 that is parallel to a direction in which a sheet is transported on the sheet transport path 1, i.e., a front surface of the apparatus 100. This facilitates removal of a jammed sheet.

Figure 3:
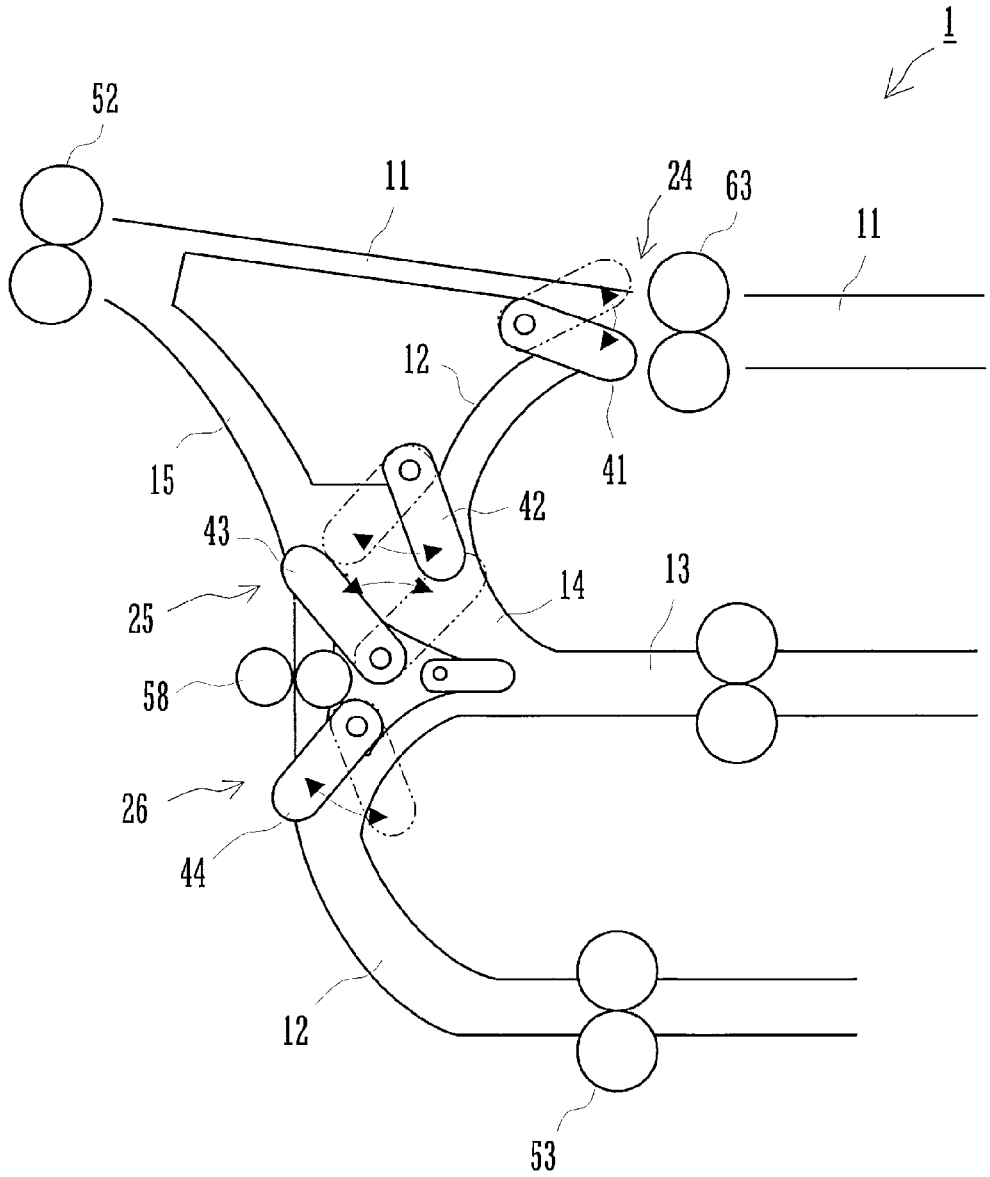
FIG. 3 is a diagram illustrating a configuration of each of first, second, and third bifurcations of the sheet transport path.

FIG. 3 is a schematic diagram illustrating a configuration of each of the first bifurcation 24, the second bifurcation 25, and the third bifurcation 26, of the sheet transport path 1. A guide 41 is provided at the bifurcation 24. The guide 41 is pivoted between two respective positions indicated by a solid line and a chain double-dashed line by a first solenoid (not shown), to guide a sheet forwarded by the roller 63 from the bifurcation 24 into either one of the paths 11 and 12.

Guides 42 and 43 are provided at the bifurcation 25. With no external force acting thereon, the guide 42 is located in a position, indicated by a solid line, to guide a sheet into the path 15 as the sheet is transported upward on the path 12 or the path 14. The guide 42 prevents a sheet from being guided into the path 12 as the sheet is transported upward from the path 12 or the path 13.

The guide 43 is pivoted between two respective positions indicated by a solid line and a chain double-dashed line by activating and deactivating a second solenoid (not shown), to allow, in the bifurcation 25, passage of a sheet from the path 14 to the path 15 or from the path 12 to the path 15.

The guide 42 is pivoted to a position indicated by a chain double-dashed line, by contact with a sheet that is transported downward from the bifurcation 24 along the path 12.

A guide 44 is provided at the bifurcation 26. The guide 44 is urged to a position indicated by a solid line by an elastic member. The elastic member exerts such an elastic force on the guide 44 as to allow the guide 44 to be pivoted to a position indicated by a chain double-dashed line by contact with a sheet that is transported to the portion 12A through the paths 11 and 12. When in contact with a leading end of a sheet transported downward along the path 12, the guide 44 allows downward passage of the sheet from the bifurcation 26 into the path 12. Otherwise, the guide 44 allows passage of a sheet from the section 12A to the path 13.

Figure 4:
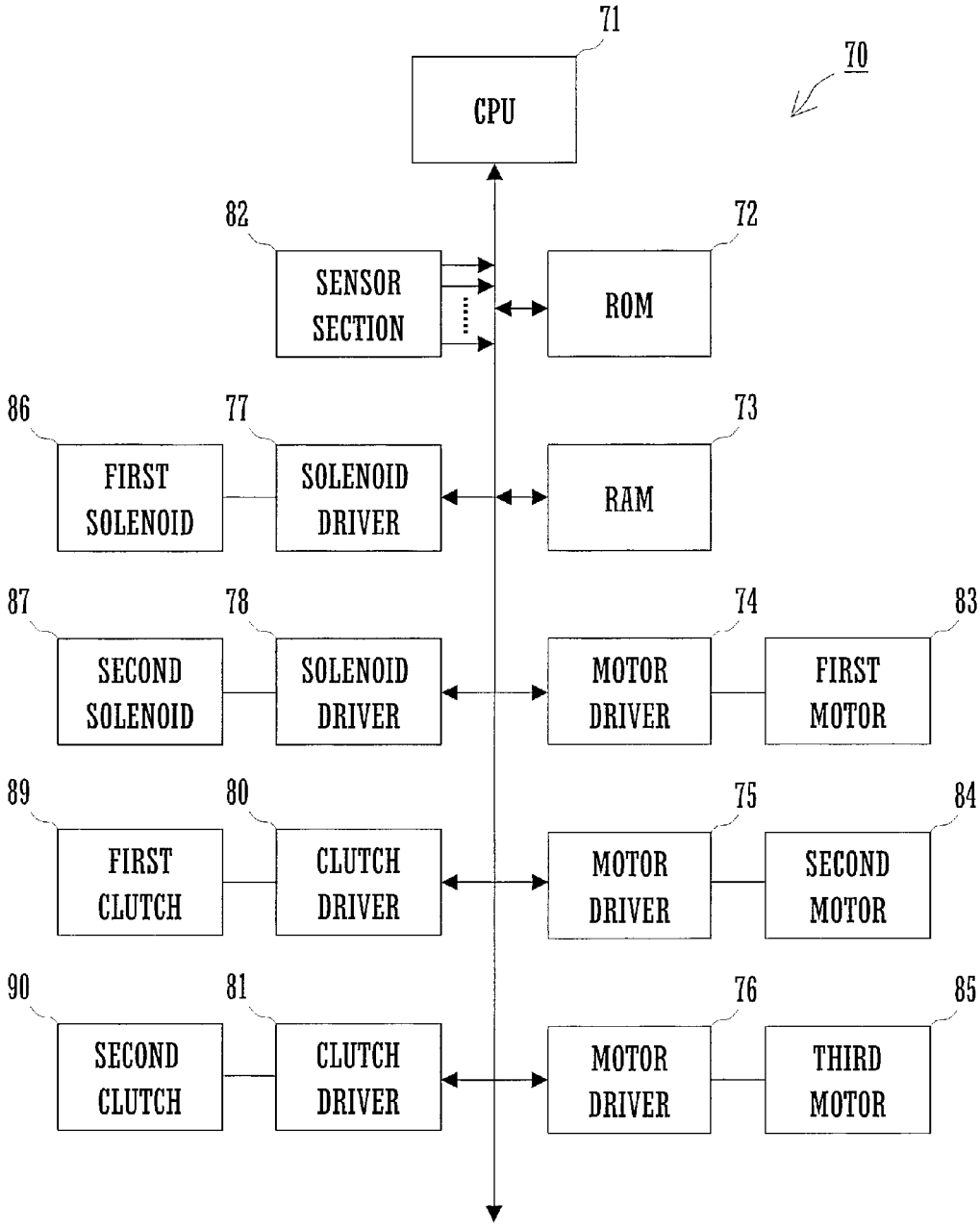
FIG. 4 is a block diagram illustrating a configuration of a control section provided in the apparatus.

FIG. 4 is a block diagram illustrating a configuration of a control section 70 provided in the apparatus 100. The control section 70 has a CPU 71 provided with a ROM 72 and a RAM 73. To the CPU 71 connected are motor drivers 74, 75, and 76, solenoid drivers 77 and 78, clutch drivers 80 and 81, and a sensor section 82.

The section 82 has a plurality of sensors arranged in the sheet transport path 1. Each of the sensors detects presence of a sheet at different locations in the path 1 and inputs a detection signal to the CPU 71.

According to the signal input by the section 82, the CPU 71 executes a program prewritten in the ROM 72 and outputs a driving signal to each of the motor drivers 74, 75, and 76, the solenoid drivers 77 and 78, and the clutch drivers 80 and 81.

To the drivers 74, 75, and 76 connected are a first motor 83, a second motor 84, and a third motor 85, respectively. The drivers 74, 75, and 76 drive the motors 83, 84, and 85, respectively, according to a driving signal from the CPU 71.

To the drivers 77 and 78 connected are a first solenoid 86 and a second solenoid 87, respectively. The drivers 77 and 78 activate the solenoids 86 and 87, respectively, according to a driving signal from the CPU 71.

In a deactivated state, the solenoid 86 puts the guide 41 in the position indicated by the solid line as shown in FIG. 3. In an activated state, the solenoid 86 puts the guide 41 in the position indicated by the chain double-dashed line. More specifically, the guide 41 guides a sheet from the bifurcation 24 into the path 11, where the output roller 52 is provided, with the solenoid 86 in the deactivated state. Meanwhile, the guide 41 guides a sheet from the bifurcation 24 into the path 12, with the solenoid 86 in the activated state.

It is to be noted that either of the respective positions indicated by the solid line and the chain double-dashed line as in FIG. 3 can be arbitrarily selected as an initial position of the guide 41 in the deactivated state. Thus, the guide 41 can be placed in an appropriate position for face-up or face-down sheet output, depending on which of the face-up or face-down sheet output a user more often uses.

In a deactivated state, the solenoid 87 puts the guide 43 in the position indicated by the solid line as shown in FIG. 3. In an activated state, the solenoid 87 puts the guide 43 in the position indicated by the chain double-dashed line. More specifically, the guide 43 guides a sheet from the bifurcation 25 into the path 13, and from the path 14 into the path 15, with the solenoid 86 in the deactivated state, whereas the guide 43 guides a sheet from the bifurcation 25 into the path 12, and from the path 12 into the path 15, with the solenoid 87 in the activated state.

To the clutch drivers 80 and 81 connected are a first clutch 89 and a second clutch 90, respectively. The drivers 80 and 81 activate the clutches 89 and 90, respectively, according to a driving signal from the CPU 71.

In a deactivated state, the clutch 89 directly transmits rotation of the second motor 84 to the reversing roller 53. In an activated state, the clutch 89 transmits, to the roller 53, rotation in an opposite direction to a rotational direction of the motor 84. More specifically, the roller 53 is rotated in a forward direction to guide a sheet into the switchback section 12A, with the clutch 89 deactivated. Meanwhile, the roller 53 is rotated in a reverse direction to guide a sheet from the section 12A to the bifurcation 26, with the clutch 89 activated.

In a deactivated state, the clutch 90 directly transmits rotation of the third motor 85 to the reversing rollers 55, 56, and 57. In an activated state, the clutch 90 transmits, the rollers 55 to 57, rotation in an opposite direction to a rotational direction of the motor 84. More specifically, the rollers 55 to 57 are rotated in a forward direction to guide a sheet from the bifurcation 25 into the path 13, with the clutch 90 deactivated. Meanwhile, the rollers 55 to 57 are rotated in a reverse direction to guide a sheet from the path 13 to the bifurcation 25, with the clutch 90 activated.

The apparatus 100 selectively performs a face-up transport operation, a face-down transport operation, and a reversing transport operation. In the face-up transport operation, a sheet with an image recorded on a single side is output to the tray 38, with the image-carrying side facing upward. In the face-down transport operation, a sheet with an image recorded on a single side is output face-down to the tray 38, with the image-carrying side facing downward. The reversing transport operation is performed when an image is to be recorded on both sides of a sheet.

The CPU 71 outputs a driving signal to each of the motor drivers 74 to 76, the solenoid drivers 77 and 78, and the clutch drivers 80 and 81, to activate the first motor 83, the second motor 84, the third motor 85, the first solenoid 86, the second solenoid 87, the first clutch 89, and the second clutch 90, so that a sheet is transported through an appropriate route for either one of the face-up, face-down, and reversing transport operations.

In a situation such as when an operator is to copy an original document on paper, the operator is near the apparatus 100 and ready to check the copied paper. In such a situation, the face-up transport operation is performed.

In the face-up transport operation, the CPU 71 drives the motor 83 through the driver 74. A sheet fed from the sheet feeding unit 400 is transported along the path 11 by rotation of each of the transport rollers 61 to 63, the registration roller 51, and the output roller 52. During passage of the sheet through the image recording section 30, a toner image is transferred and fused on an upper side of the sheet. The sheet is output to the tray 38 with the image-carrying side facing upward.

The CPU 71 starts to transmit rotation of the motor 83 to the roller 51, through a clutch (not shown in the figure), at such a timing that a leading end of the sheet meets a leading end of the toner image formed on the drum 31 in a contact area between the roller 35A and the drum 31.

Figure 5:
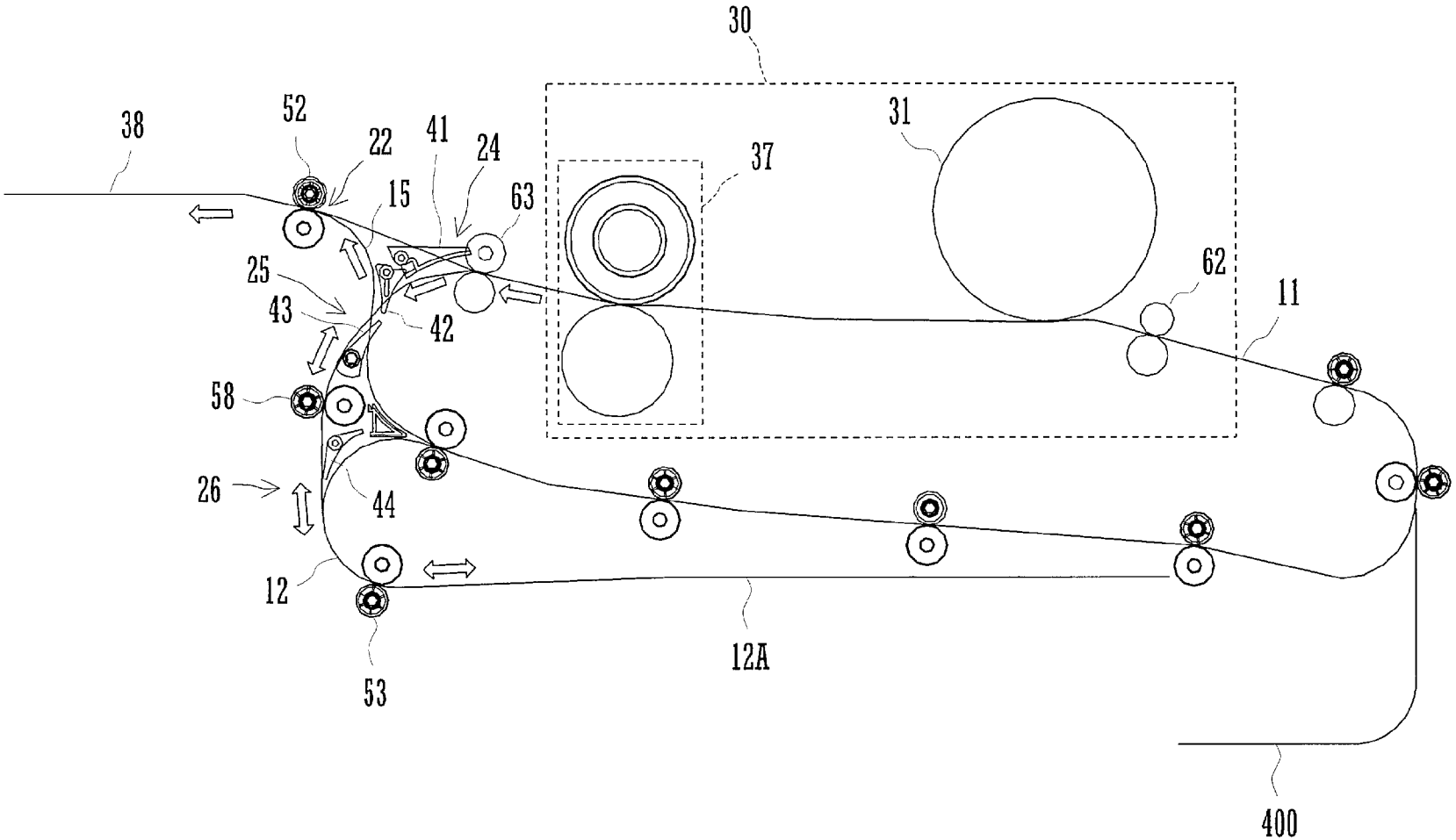
FIG. 5 is a schematic diagram illustrating a first route for a sheet to follow in a face-down transport operation.

FIG. 5 is a schematic diagram illustrating a first route for a sheet to follow in the face-down transport operation. In this case, the guide 44 is pivoted from the position indicated by the solid line to the position indicated by the chain double-dashed line as in FIG. 3, by a third solenoid (not shown). Also, the transport roller 58 serves as a reversing roller. To the roller 58, the clutch 89 transmits rotation of the second motor 84. Thus, the roller 58 is rotated in a similar manner to the roller 53.

In a situation such as when an image is to be printed on paper according to image data sent from an external device by an operator, the operator is not around the apparatus 100 and therefore not ready to check the printed paper. In such a situation, the face-down transport operation is performed. The face-down transport operation is also performed when images on consecutive pages of an original document are to be recorded on sheets of paper, for the purpose of eliminating the need for collating the recorded sheets.

In the face-down transport operation, the CPU 71 drives the motor 83 through the driver 74 to transport, to the section 30, a sheet fed from the unit 400. The CPU 71 activates the first solenoid 86 and the second solenoid 87 through the solenoid drivers 77 and 78 before a leading end of the sheet reaches the first bifurcation 24. Thus, the guides 41 and 43 are put in the respective positions indicated by the chain double-dashed lines as in FIG. 3, so that the sheet is guided from the bifurcation 24 into the path 12 after passing through the section 30.

The CPU 71 drives the second motor 84 through the motor driver 75 by the time the leading end of the sheet passes through the second bifurcation 25. At the time, the first clutch 89 is not activated. Thus, the reversing roller 53 and the transport roller 58 are rotated in the forward directions.

The sheet is transported downward along the path 12 toward the switchback section 12A. It is to be noted that the guides 42 and 44 are pivoted to the respective positions indicated by the chain double-dashed lines by contact with the leading end of the sheet as the sheet is transported downward through the bifurcation 25, thereby allowing passage of the sheet through the path 12.

As the sheet is transported downward through the third bifurcation 26, a tail end of the sheet becomes nipped by the reversing roller 53. It is when the CPU 71 activates the clutch 89 through the clutch driver 80. Thus, the rollers 53 and 58 are rotated in the reverse directions. The CPU 71 also activates the second solenoid 87 and the third solenoid in order to pivot the guides 43 and 44 to the respective positions indicated by the chain double-dashed lines as in FIG. 3.

With the tail end leading, the sheet is transported upward from the section 12A along the path 12, and is guided into the path 15 at the bifurcation 25. Then, the sheet is guided into the path 11 at the second confluence 22, and is output to the tray 38, with the image-carrying side facing downward, by the roller 52.

Figure 6:
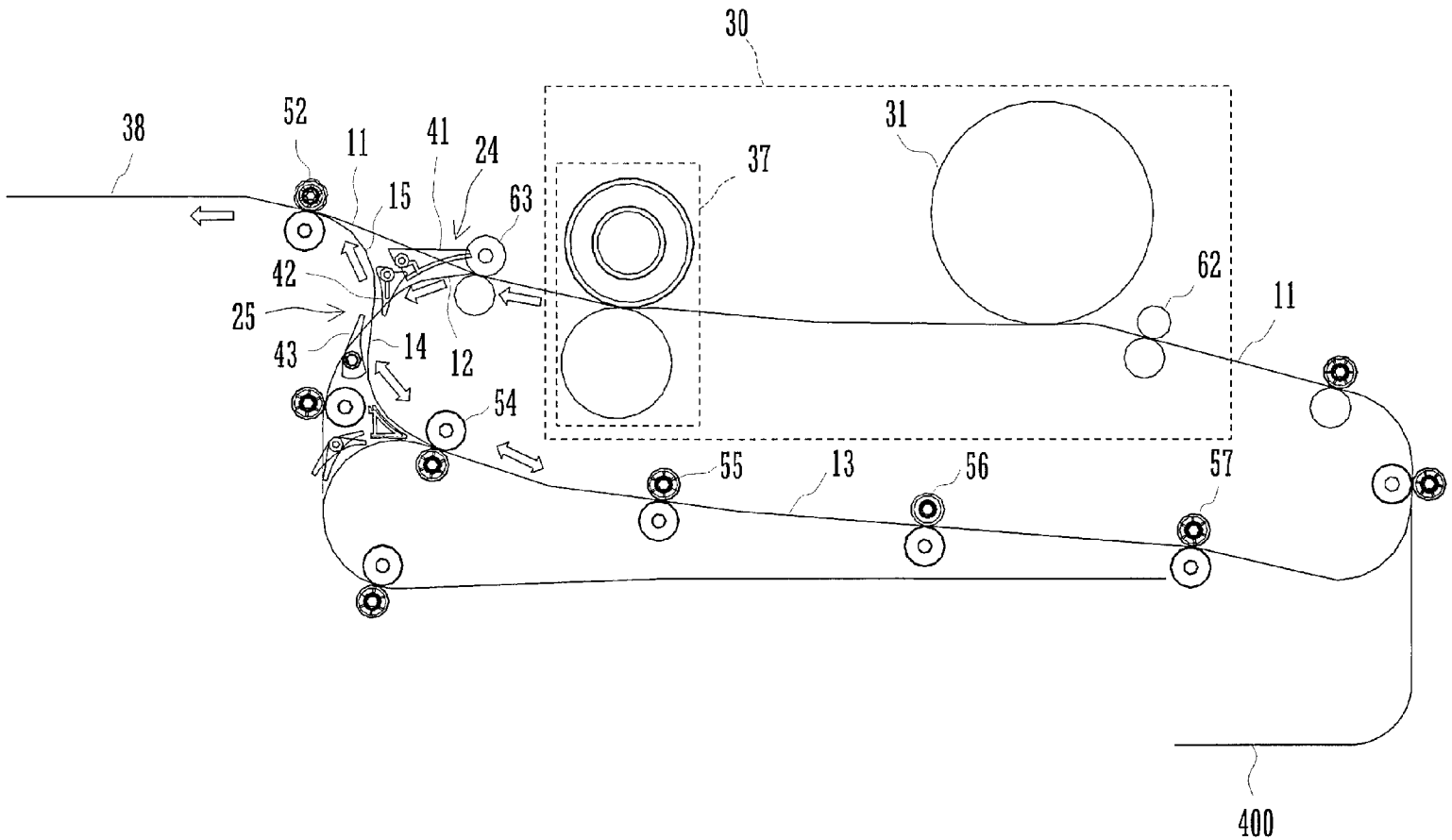
FIG. 6 is a schematic diagram illustrating a second route for a sheet to follow in a face-down transport operation.

FIG. 6 is a schematic diagram illustrating a second route for a sheet to follow in the face-down transport operation. The CPU 71 drives the motor 83 through the driver 74 to transport, to the section 30, a sheet fed from the unit 400. The CPU 71 activates the first solenoid 86 through the solenoid driver 77 before a leading end of the sheet reaches the bifurcation 24. Thus, the guide 41 is put in the position indicated by the chain double-dashed line as in FIG. 3, so that the sheet is guided from the bifurcation 24 into the path 12 after passing through the section 30. It is to be noted that the guide 42 is pivoted to the position indicated by the chain double-dashed line by contact with the leading end of the sheet as the sheet is transported downward through the bifurcation 25, thereby allowing passage of the sheet through the path 12.

At the time, the second solenoid 87 is not activated. Thus, the guide 43 is put in the position indicated by the solid line as in FIG. 3, so that the sheet is guided from the path 12 into the path 14 at the bifurcation 25.

The CPU 71 drives the third solenoid 85 through the motor driver 76 by the time the leading end of the sheet passes through the bifurcation 25. At the time, the clutch 89 is not activated. Thus, the reversing rollers 54, 55, 56, and 57 are rotated in the forward directions, so that the sheet is guided from the path 14 into the path 13.

With a tail end of the sheet nipped by the roller 54, the CPU 71 activates the second clutch 90 through the clutch driver 81. Thus, the reversing rollers 54, 55, 56, and 57 are rotated in the reverse directions. With the tail end leading, the sheet is transported, upward from the path 13, along the path 14 and is guided into the path 15 at the bifurcation 25. Then, the sheet is guided into the path 11 at the second confluence 22, and is output to the tray 38, with the image-carrying side facing downward, by the roller 52.

In this case, the path 13 is used to reverse the leading and tail ends of a sheet. The path 13 is located above the section 12A, and therefore nearer to the path 11 than the section 12A. After leading and tail ends of a sheet are reversed in the path 13, the sheet is output to the tray 38. This allows a shorter sheet transport route, and therefore a shorter image recording process time in the face-down transport operation, compared to a case in which the section 12A is used.

Figure 7:
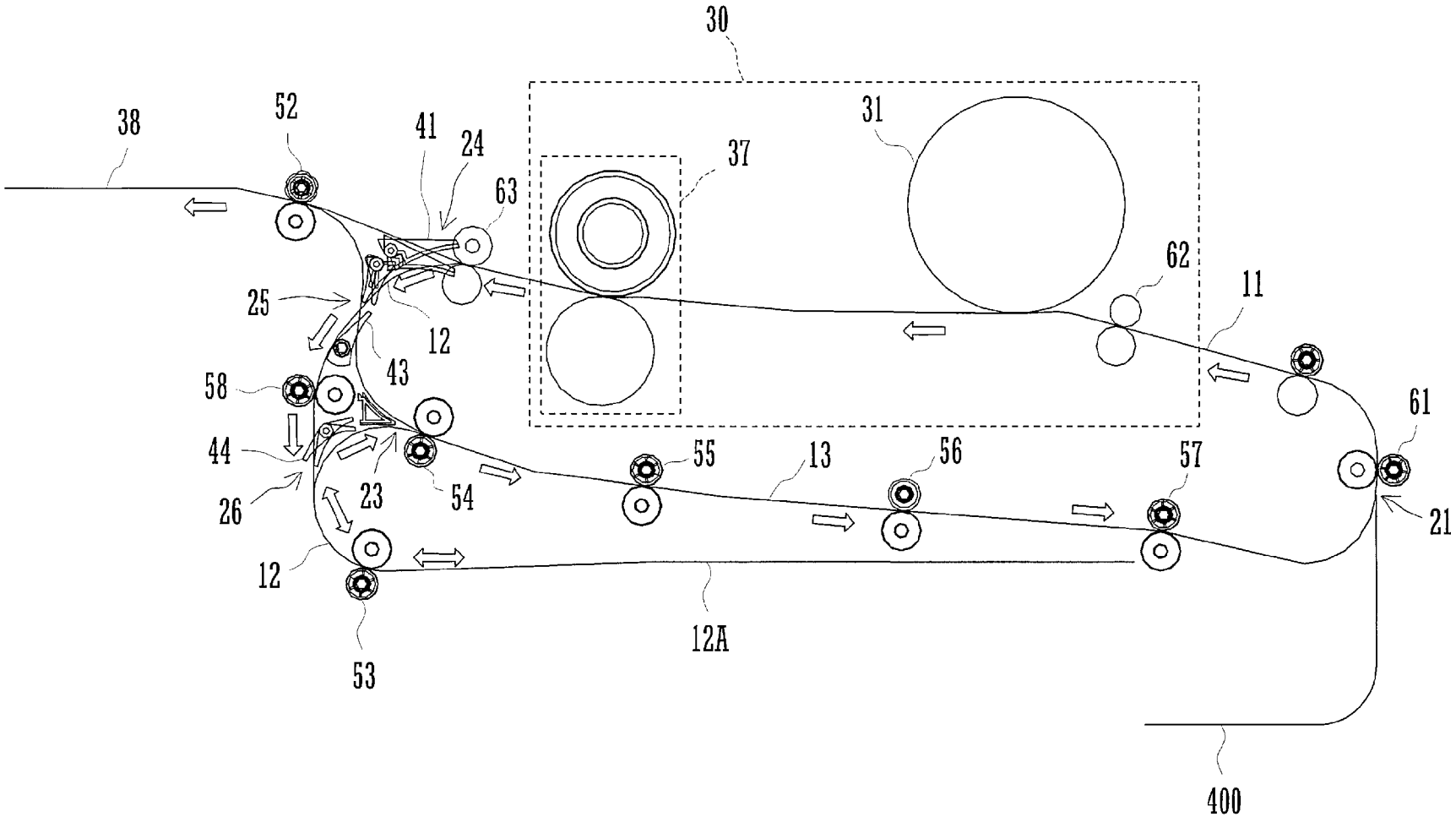
FIG. 7 is a schematic diagram illustrating a route for a sheet to follow in a reverse transport operation.

FIG. 7 is a schematic diagram illustrating a route for a sheet to follow in the reverse transport operation. The reverse transport operation is performed when an image is to be recorded on both sides of a sheet. In the reverse transport operation, an image is recorded on a first side of the sheet in the section 30; the sheet is reversed and returned to the section 30 where an image is recorded on a second side of the sheet; and then, the sheet is output to the tray 38.

In the reverse transport operation, the CPU 71 drives the motor 83 through the driver 74 to transport, to the section 30, a sheet fed from the unit 400. The CPU 71 activates the first solenoid 86 and the second solenoid 87 through the solenoid drivers 77 and 78 before a leading end of the sheet reaches the bifurcation 24. Thus, the guides 41, 43, and 44 are put in the respective positions indicated by the chain double-dashed lines as in FIG. 3, so that the sheet is guided from the bifurcation 24 into the path 12 after an image is formed on a first side o the sheet in the section 30.

The CPU 71 drives the second motor 84 through the motor driver 75 by the time the leading end of the sheet passes through the bifurcation 25. At the time, the first clutch 89 is not activated. Thus, the reversing roller 53 and the transport roller 58 are rotated in the forward directions.

Consequently, the sheet is transported along the path 12 toward the switchback section 12A. It is to be noted that the guide 42 is pivoted to the position indicated by the chain double-dashed line by contact with the leading end of the sheet as the sheet is transported downward through the bifurcation 25, thereby allowing passage of the sheet through the path 12.

As the sheet is transported downward through the bifurcation 26, a tail end of the sheet becomes nipped by the reversing roller 53. It is when the CPU 71 activates the clutch 89 through the clutch driver 80 and, at the same time, deactivates the solenoid 87. Further, the CPU 71 drives the motor 85 through the driver 76. At the time, the clutch 90 is not activated. Thus, the roller 53 is rotated in the reverse direction, and the rollers 54, 55, 56, and 57 are rotated in the forward directions. At the bifurcation 26, at the time, the guide 44 is in the position indicated by the solid line as in FIG. 3.

With the tail end leading, the sheet is transported, upward from the section 12A, along the path 12 and is guided into the path 13 at the bifurcation 26. Next, the sheet is transported along the path 13 toward the first confluence 21. Then, the sheet is guided into the path 11 at the confluence 21, and is transported along the path 11 to the section 30 with a second side facing the drum 31.

By the time the leading end of the sheet with the second side facing upward passes through the section 30, the CPU 71 deactivates the solenoid 86. Thus, the guide 41 is put in the position indicated by the solid line as in FIG. 3. After an image is recorded on the second side in the section 30, the sheet is transported through the bifurcation 24 and output to the tray 38 by the roller 52.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image recording apparatus, comprising:

a sheet feeding section for storing sheets;

an image recording section for recording an image on a side of a sheet;

a sheet output section for receiving a sheet with an image recorded thereon;

a switchback section for transporting a sheet in forward and backward directions;

a first transport path that leads from the sheet feeding section to the sheet output section, through a first confluence, the image recording section, a first bifurcation, and a second confluence in that order;

a second transport path that leads from the first bifurcation down to the switchback section through a second bifurcation and a third bifurcation in that order;

a third transport path that leads from the third bifurcation to the first confluence through a third confluence, the third transport path being positioned between the switchback section and a portion of the first transport path located in the image recording section;

a fourth transport path that leads between the second bifurcation and the third confluence; and a fifth transport path that leads from the second bifurcation to the second confluence, wherein the third transport path is adapted to transport a sheet in forward and backward directions, the apparatus further comprising a control section configured to perform the steps of;

causing the image recording section to record an image on a side of a sheet;

transporting the sheet from the image recording section to the third transport path, through the first transport path, the first bifurcation, the second transport path, the second bifurcation, the fourth transport path, and the third confluence in that order;

reversing a leading end and a tail end of the sheet in the third transport path;

transporting the sheet from the third transport path to the first transport path through the third confluence, the fourth transport path, the fifth transport path, and the second confluence in that order; and outputting the sheet to the sheet output section with the image-recorded side facing downward.

2. The image recording apparatus according to claim 1, wherein the switchback section is arranged approximately parallel to the portion of the first transport path located in the image recording section.

3. The image recording apparatus according to claim 1, wherein the control section is configured to perform the steps of:

causing the image recording section to record an image on a first side of a sheet;

transporting the sheet from the image recording section to the switchback section through the first transport path, the first bifurcation, and the second transport path in that order;

reversing a leading end and a tail end of the sheet in the switchback section;

transporting the sheet from the switchback section to the image recording section through the third bifurcation, the third transport path, and the first confluence in that order; and causing the image recording section to record an image on a second side of the sheet.

4. The image recording apparatus according to claim 1, wherein the switchback section includes a single reversing transport member positioned between the third bifurcation and the switchback section along the second transport path.

* * * * *